US006366178B1

(12) United States Patent
Makino et al.

(10) Patent No.: US 6,366,178 B1
(45) Date of Patent: Apr. 2, 2002

(54) NON-RECIPROCAL CIRCUIT DEVICE WITH CAPACITOR TERMINALS INTEGRAL WITH THE GROUND PLATE

(75) Inventors: Toshihiro Makino, Matto; Takashi Hasegawa, Kanazawa; Masakatsu Mori; Takahiro Jodo, both of Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/610,514

(22) Filed: Jul. 6, 2000

(30) Foreign Application Priority Data

Jul. 6, 1999 (JP) ..... 11-192304
May 15, 2000 (JP) ..... 2000-142058

(51) Int. Cl.[7] ..... H01P 1/36; H01P 1/383
(52) U.S. Cl. ..... 333/1.1; 333/24.2
(58) Field of Search ..... 333/1.1, 24.2

(56) References Cited

U.S. PATENT DOCUMENTS 6,107,895 A * 8/2000 Butland et al. ..... 333/1.1
6,121,851 A * 9/2000 Takane et al. ..... 333/1.1

* cited by examiner

*Primary Examiner*—Justin P. Bettendorf
(74) *Attorney, Agent, or Firm*—Ostrolenk, Faber, Gerb & Soffen, LLP

(57) ABSTRACT

A highly reliable nonreciprocal circuit device facilitating incorporation of matching capacitors and a communication apparatus incorporating the same are disclosed. In the non-reciprocal circuit device, central conductors are integrally extended from a ground plate abutting on the bottom of a ferrite plate to be mutually crossed on the upper surface of the ferrite plate via an insulation sheet after passing over the side surfaces of the ferrite plate. Matching capacitors are connected by soldering between capacitor-connecting terminals integrally extended from the ground plate and the ports of the central conductors in such a manner that electrode surfaces of the matching capacitors are set perpendicularly with respect to a main surface of the ferrite plate.

8 Claims, 8 Drawing Sheets

C3
P3
5
C2
C1
54b
54a
52
55
53
51
P2
P1

5
C2
P2
P1
C1
54b
54a
54
55
52
53
51

NON-RECIPROCAL CIRCUIT DEVICE WITH CAPACITOR TERMINALS INTEGRAL WITH THE GROUND PLATE

BACKGROUND OF THE INVENTION

1. Field of the Invention

The present invention relates to nonreciprocal circuit devices such as isolators and circulators used in high frequency bands including microwave bands, and the invention also relates to communication apparatuses incorporating the same.

2. Description of the Related Art

In recent mobile communication apparatuses such as cellular phones, with the miniaturization of the apparatuses, a demand for cost reduction has been on the increase. As a result, reducing the sizes and production costs of nonreciprocal circuit devices have also been strongly demanded. In order to satisfy such a demand for miniaturization and cost reduction, there is a nonreciprocal circuit device provided by the assignee of the present invention in Japanese Patent Application No. 9-252207. The nonreciprocal circuit device as an isolator has a structure in which a single-plate-type capacitor is used as a matching capacitor, which is disposed perpendicularly with respect to a surface to be mounted. That is, the isolator has the structure in which the capacitor is vertically disposed.

As shown in FIG. 10, in this isolator, a permanent magnet 3 is disposed on an inner surface of an upper yoke 2, which is fit on an lower yoke 8 to form a magnetic closed circuit. A terminal case 7 is placed on the bottom surface inside the lower yoke 8. Inside the terminal case 7 are disposed a magnetic assembly 15, three matching capacitors C1 to C3, and a terminating resistor R. The permanent magnet 3 applies a DC magnetic field to the magnetic assembly 15.

In the magnetic assembly 15, three central conductors 51 to 53 are electrically insulated from each other and intersected on the upper surface of a ferrite plate 55. Ports P1 to P3 formed at one end of each of the central conductors 51 to 53 are bent at 90 degrees, and a common ground plate 54 at the other end of each of the three central conductors 51 to 53 abuts on the bottom surface of the ferrite plate 55. In a developed view shown in FIG. 11, the central conductors 51 to 53 are mutually connected by being integrated at a central area, which is equivalent to the ground plate 54, from which the central conductors 51 to 53 are outwardly extended. The ground plate 54, which substantially covers the bottom surface of the ferrite plate 55, is connected to the bottom wall 8*b* of the lower yoke 8 via a through-hole 7*c* of the terminal case 7.

In the terminal case 7, input/output terminals 71 and 72, and ground terminals 73 are insert-molded. One end of each of the terminals 71 to 73 is exposed outside the terminal case 7, and the other end thereof is exposed on the inner side wall of the terminal case 7. The matching capacitors C1 to C3 are disposed on the inner side walls of the terminal case 7 in such a manner that the electrode surfaces of the matching capacitors C1 to C3 make at angles of 90 degrees with respect to the upper and lower main surfaces of the ferrite plate 55. The ports P1 to P3 of the central conductors 51 to 53 are connected to hot-side electrodes of the matching capacitors C1 to C3. In addition, the ports P1 to P3 are connected to the input/output terminals 71 and 72 exposed on the inner side walls of the terminal case 7. Cold-side electrodes of the matching capacitors C1 to C3 are connected to the ground terminals 73 exposed on the inner side wall of the terminal case 7. One end of the terminating resistor R is connected to the hot-side electrode of the matching capacitor C3, the other end thereof is connected to the ground terminals 73. These components are electrically connected by soldering.

In the above conventional isolator, after the magnetic assembly 15 is incorporated into the terminal case 7, the matching capacitors C1 to C3 must be inserted between the ports P1 to P3 and the ground terminals 73 on the inner side wall of the terminal case 7 while vertically standing the matching capacitors C1 to C3. In addition, the electrodes of the matching capacitors C1 to C3 need to be connected to the ports P1 to P3 and the ground terminals 73 by soldering.

However, due to the miniaturization of the isolator and the components constituting the isolator, it is difficult and time-consuming to insert the small matching capacitors C1 to C3 in such narrow spaces between the ports P1 to P3 and the terminal case 7. Furthermore, since the ports P1 to P3 of the central conductors 51 to 53 need to be bent at right angles in advance, variations in the angles at which the ports P1 to P3 are bent can lead to unsteady soldering of the ports P1 to P3 to the matching capacitors C1 to C3. In addition, due to variations occurring in the state in which the magnetic assembly 15 is incorporated, the distance between the ports P1 to P3 and the ground terminals 73 is also varied, with the result that soldering the ports P1 to P3 to the matching capacitors C1 to C3 can be stabilized. Furthermore, with solder flowing out in the soldering process, the hot-side electrodes of the matching capacitors C1 to C3 and the cold-side electrodes thereof are short-circuited, thereby causing reduction in yields.

SUMMARY OF THE INVENTION

Accordingly, it is an object of the present invention to provide a highly reliable nonreciprocal circuit device into which matching capacitors can be easily incorporated, and a communication apparatus using the same.

To this end, according to one aspect of the present invention, there is provided a nonreciprocal circuit device including a ferrite plate having a first main surface and a second main surface, the ferrite plate being adapted to receive a DC magnetic field applied by a permanent magnet; a ground plate made of a conductive plate; a plurality of central conductors integrally extended from the ground plate, an end portion of each of the central conductors defining a port; a plurality of capacitor-connecting terminals integrally extended from the ground plate; and a plurality of matching capacitors, each having an electrode formed on each main surface thereof; wherein the ground plate abuts on the second main surface of the ferrite plate, and the plurality of central conductors are electrically insulated from each other while being extended along the side surfaces of the ferrite plate and mutually crossing on the first main surface of the ferrite plate; the plurality of matching capacitors are disposed between the ports of the central conductors and the plurality of capacitor-connecting terminals to be electrically connected to the ports and the terminals; and at least one of the matching capacitors are disposed in such a manner that the electrode surfaces thereof define an angle from 60 to 120 degrees with respect to one of the main surfaces of the ferrite plate.

In the above arrangement, the matching capacitors are connected between the central conductors and the capacitor-connecting terminals integrally placed with the central conductors disposed on the ferrite plate. As a result, the matching capacitors integrated with the central conductors and the ferrite plate can be regarded as a part of a single unit. This arrangement permits incorporation of the matching capacitors to be facilitated.

In addition, the above nonreciprocal circuit device may further include an insulator for preventing an outflow of solder disposed in the vicinity of each of the parts where the plurality of capacitor-connecting terminals are connected to the plurality of matching capacitors and in the vicinity of each of the ports of the plurality of central conductors. With this arrangement, since the outflow of solder is controlled when soldering the matching capacitors, for example, this prevents hot-side electrodes of the matching capacitors and cold-side electrodes thereof from being short-circuited.

In addition, the above nonreciprocal circuit device may further include an insulator for preventing a short circuit disposed at each of the parts where the central conductors are close to the matching capacitors. With this arrangement, the central conductors are not short-circuited with the matching capacitors even when the central conductors contact with the matching capacitors due to an external force or variations in assembly.

Furthermore, according to another aspect of the present invention, there is provided a communication apparatus including the above nonreciprocal circuit device. The communication apparatus of the present invention can be produced at low cost with high reliability.

DESCRIPTION OF THE PREFERRED EMBODIMENTS

A description will be given of the structure of an isolator according to a first embodiment of the present invention with reference to FIGS. 1 to 6.

Figure 1:
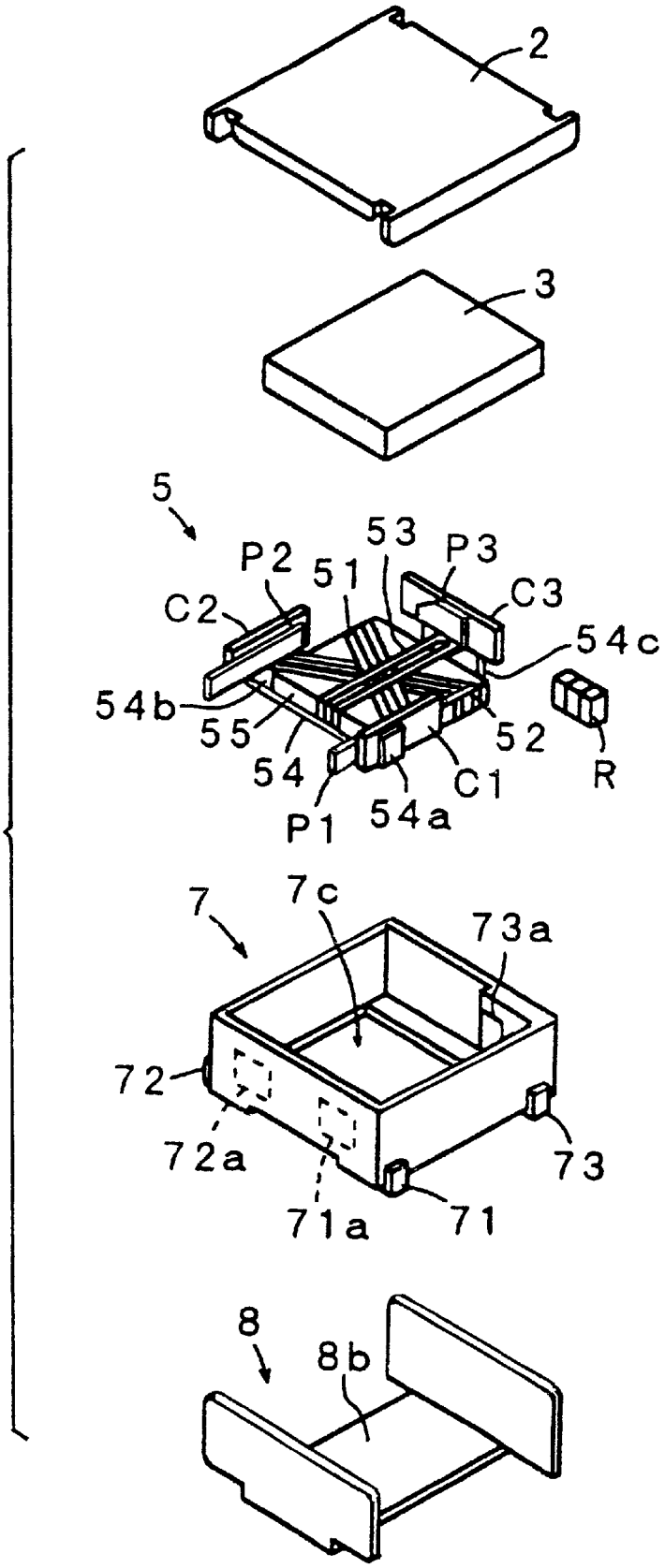
FIG. 1 shows the exploded perspective view of an isolator in accordance with a first embodiment of the present invention.

As shown in FIG. 1, in the isolator of the first embodiment, a permanent magnet 3 is disposed on the inner surface of an upper yoke 2 formed by a magnetic-metal box. The upper yoke 2 is fit on a substantially U-shaped lower yoke 8 made of a magnetic metal to form a magnetic closed circuit. A resin terminal case 7 is disposed on a bottom wall 8*b* of the lower yoke 8, and inside the terminal case 7 are disposed a central-conductor assembly 5 and a terminating resistor R. The permanent magnet 3 applies a DC magnetic field to the central-conductor assembly 5. The bottom surface of the terminal case 7, which is the lower surface of the terminal case 7 in FIG. 1, is used as a surface to be mounted. With this arrangement, the isolator of the first embodiment is surface-mounted on a substrate constituting a transmission/reception circuit section in a mobile communication apparatus such as a cellular phone.

Each of the central conductors 51, 52, and 53 used in this embodiment is formed by stamping a metal conductive plate. As shown in the developed view of FIG. 2, the central conductors 51, 52, and 53 are integrated by a ground plate 54 as a common ground end and are outwardly extended from the ground plate 54. Ports P1 to P3 at the end portions of the central conductors 51 to 53 are formed in configurations suitable to be connected to other members. In addition, capacitor-connecting terminals 54*a*, 54*b*, and 54*c*, which are continued to the ground plate 54, are integrally disposed with the above structure. The capacitor-connecting terminals 54*a*, 54*b*, and 54*c* are outwardly extended from the ground plate 54. The capacitor-connecting terminals 54*a*, 54*b*, and 54*c* have configurations suitable to be connected to matching capacitors C1 to C3. The ground plate 54 has substantially the same configuration as that of the bottom surface of a ferrite plate 55.

Figure 3:
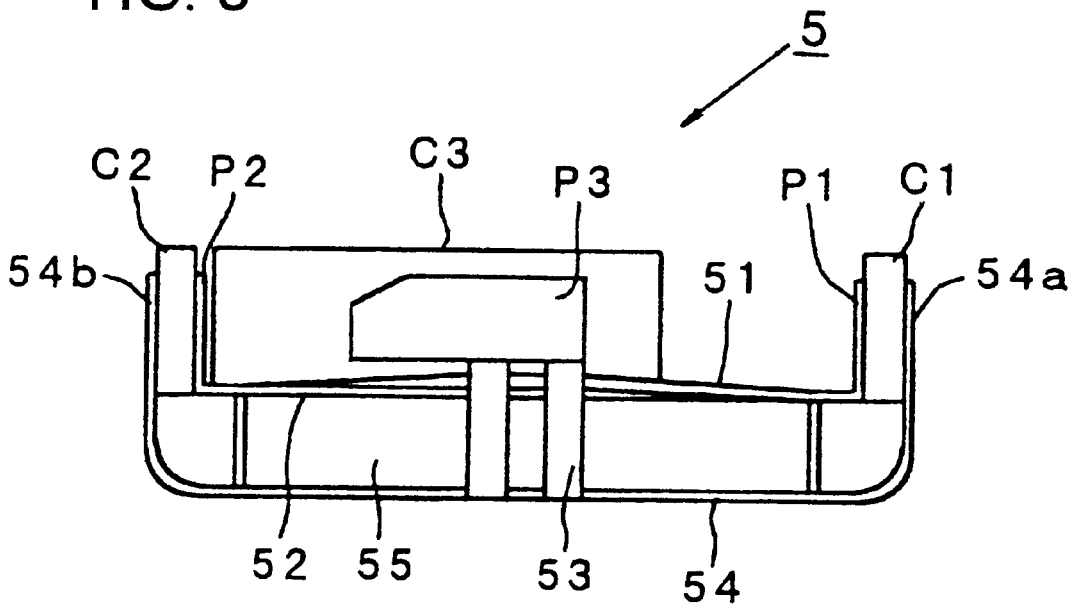
FIG. 3 shows the front view of a central-conductor assembly in accordance with the first embodiment.
Figure 4:
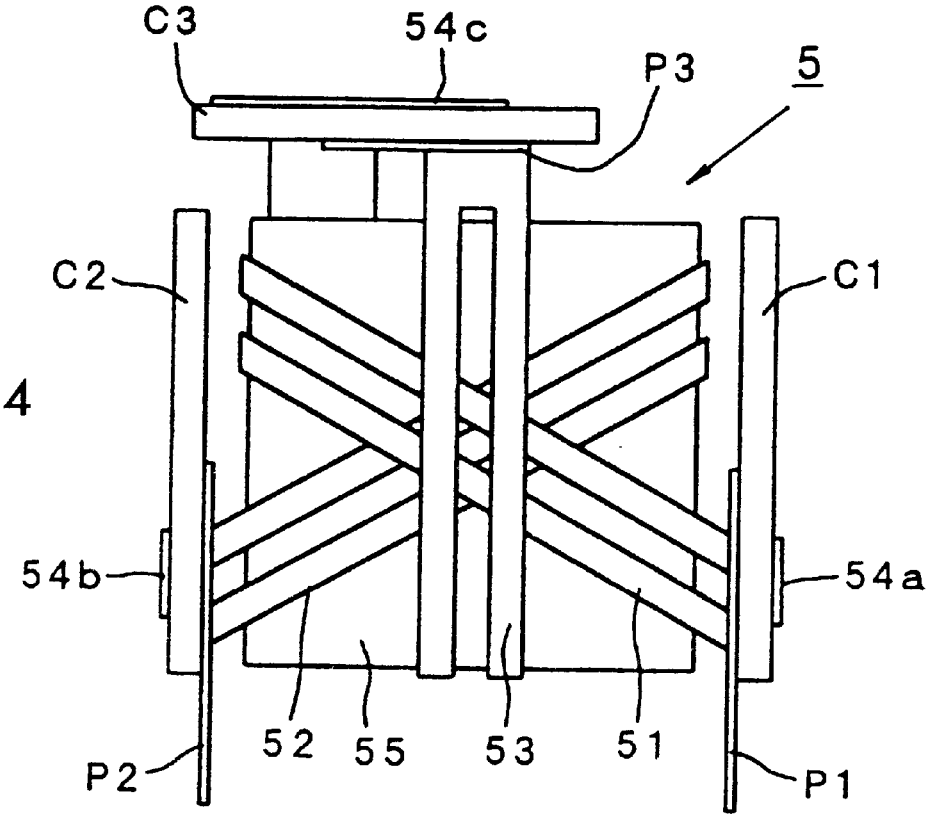
FIG. 4 shows the plan view of the central-conductor assembly in accordance with the first embodiment.

As shown in FIGS. 3 and 4, on the upper surface (a first main surface) of the rectangular ferrite plate 55, the three central conductors 51 to 53 are mutually crossed at angles of substantially 120 degrees via an insulation sheet (not shown in the figure) so that the central-conductor assembly 5 is formed. Ports P1 to P3 at the end portions of the central conductors 51 to 53 are bent at 90 degrees, and the ground plate 54 common to the remaining end portions of the central conductors 51 to 53 abuts on the lower surface (a second main surface) of the ferrite plate 55. The capacitor connecting terminals 54*a* to 54*c* are stood up in parallel to the ports P1 to P3 of the central conductors 51 to 53. The ground plate 54 is connected to a bottom wall 8*b* of the lower yoke 8 via a through-hole 7*c* of the terminal case 7 to be grounded.

The matching capacitors C1 to C3 are single-plate type capacitors, each having an electrode formed on each main surface of a dielectric substrate. The hot-side electrodes of the matching capacitors C1 to C3 are connected to the ports P1 to P3 by soldering, and the cold-side electrodes thereof are connected to the capacitor-connecting terminals 54*a*, 54*b*, and 54*c* by soldering. In this case, the electrode surfaces of each of the matching capacitors C1 to C3 define an angle of 60 to 120 degrees with respect to the upper surface of the ferrite plate 55. The angle defined by the electrode surfaces and the upper surface of the ferrite plate 55 in the first embodiment is set at substantially 90 degrees. Both main surfaces of the ferrite plate 55 are disposed in parallel to the surface on which the isolator is mounted. In this specification, a vertical direction is equivalent to a direction perpendicular to both main surfaces of the ferrite plate 55.

Figure 12:
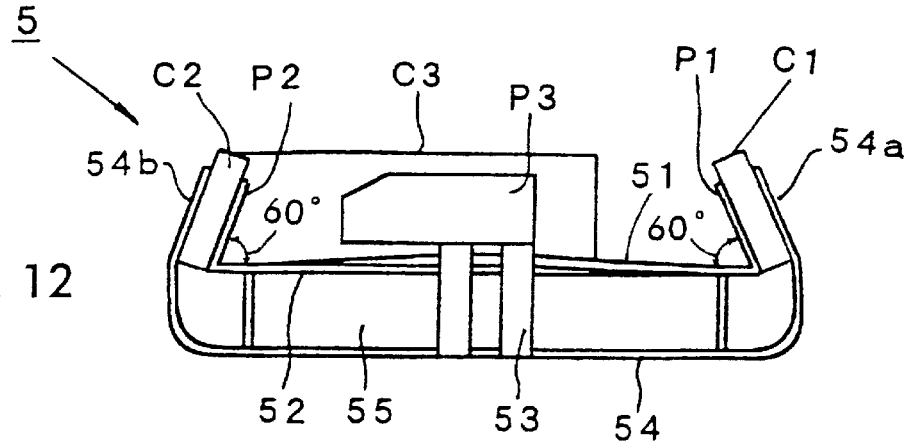
FIG. 12 shows the front view of a central-conductor assembly in accordance with another embodiment.
Figure 13:
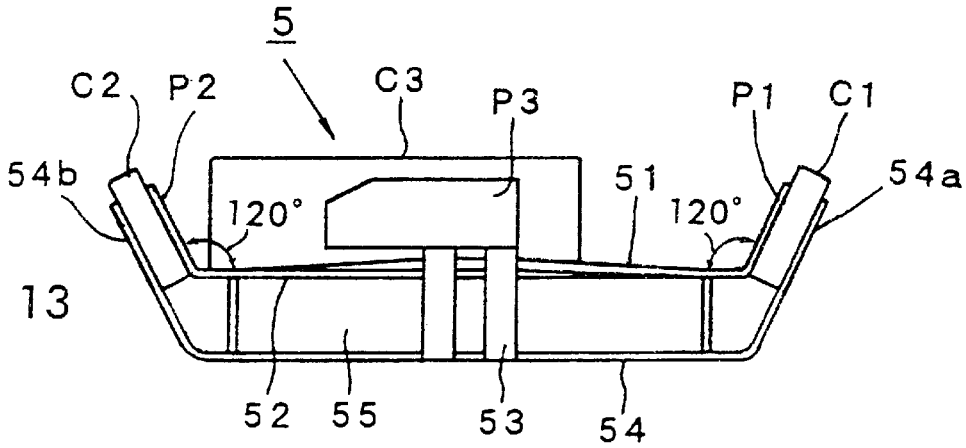
FIG. 13 shows the front view of a central-conductor assembly in accordance with another embodiment.
Figure 14:
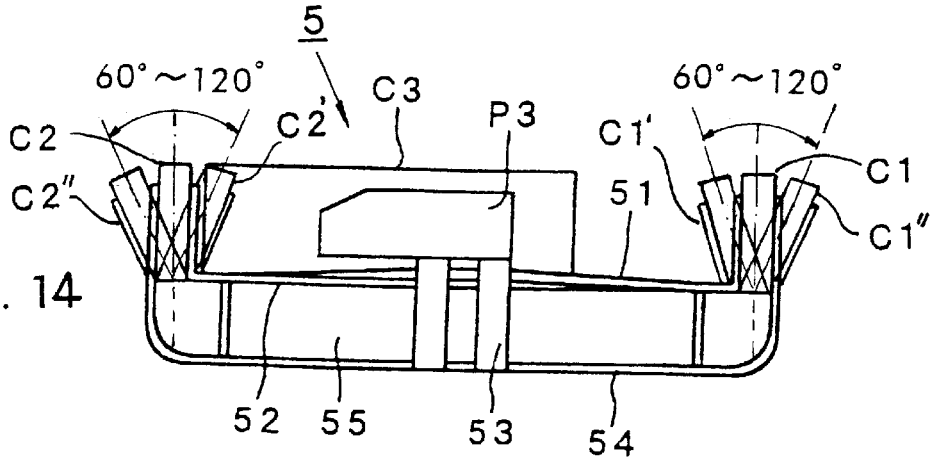
FIG. 14 is the front view of a central-conductor assembly showing a range of the angle defined by the matching capacitors.

Further, FIGS. 12–14 shows variations of angles defined by the electrode surfaces and the upper surface of the ferrite plate 55. In FIG. 12, for example, the electrode surfaces of each of the matching capacitors C1 to C3 define an angle of 60 degrees with respect to the upper surface of the ferrite plate 55.

In FIG. 13, for example, the electrode surfaces of each of the matching capacitors C1 to C3 define an angle of 120 degrees with respect to the upper surface of the ferrite plate 55.

FIG. 14 shows a range of angles defined by the electrode surfaces of the matching capacitors and the upper surface of the ferrite plate. For example, the range includes the angle of 60 degrees to 120 degrees in which the matching capacitor C1 is inclined from the point C1' to the point C1". The matching capacitors C2 and C3 also include the same range.

Figure 5:
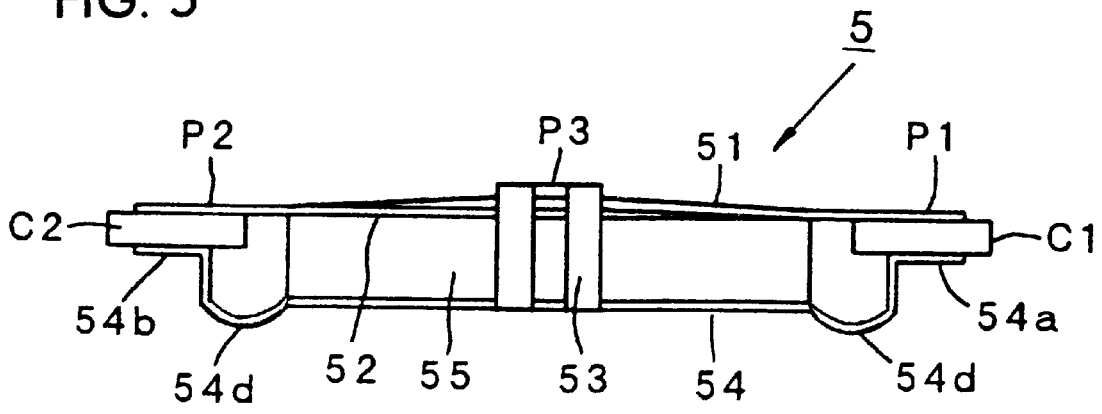
FIG. 5 shows a view illustrating matching capacitors incorporated in the central-conductor assembly in accordance with the first embodiment.

The matching capacitors C1 to C3 are incorporated, for example, as shown in FIG. 5. With the assumption that the capacitor-connecting terminals 54*a* to 54*c* are bent, bends 54*d* are formed in advance at each of the parts where the capacitor-connecting terminals 54*a* to 54*c* are joined to the ground plate 54 to provide dimensional leeway. At specified parts on the electrode surfaces of each of the matching capacitors C1 to C3, solder paste is applied in advance by a screen-printing method or the like. In addition, the matching capacitors C1 to C3 having the preliminary solder disposed thereon are inserted between the ports P1 to P3 of the central conductors 51 to 53 and the capacitor-connecting terminals 54*a* to 54*c* of the ground plate 54. That is, the matching capacitors C1 to C3 are sandwiched between the ports P1 to P3 and the capacitor-connecting terminals 54*a* to 54*c*, which are integrally formed. Next, while pressuring the ports P1 to P3 and the capacitor-connecting terminals 54*a* to 54*c* by a pressuring jig, the solder paste is heated in a reflowing furnace or the like to perform soldering of the matching capacitors C1 to C3. Then, the capacitor-connecting terminals 54*a* to 54*c* and the ports P1 to P3 are bent to be disposed in such a manner that the electrode surfaces of the matching capacitors C1 to C3 are set substantially perpendicularly to the upper surface of the ferrite plate 55. In this way, the central-conductor assembly 5 shown in FIGS. 3 and 4 can be obtained.

Input/output terminals 71, 72, and a ground terminal 73 are insert-molded on the resin terminal case 7. An end of each of the input/output terminals 71 and 72 is exposed on an outer side wall of the terminal case 7, and the other end of each thereof is exposed on an inner side wall of the terminal case 7 to form input/output connecting electrode portions 71*a* and 72*a*. An end of the ground terminal 73 is exposed on the outer side wall of the terminal case 7, and the other end thereof is exposed on an inner side wall of the terminal case 7 to form a ground-connecting electrode portion 73*a*.

Figure 6:
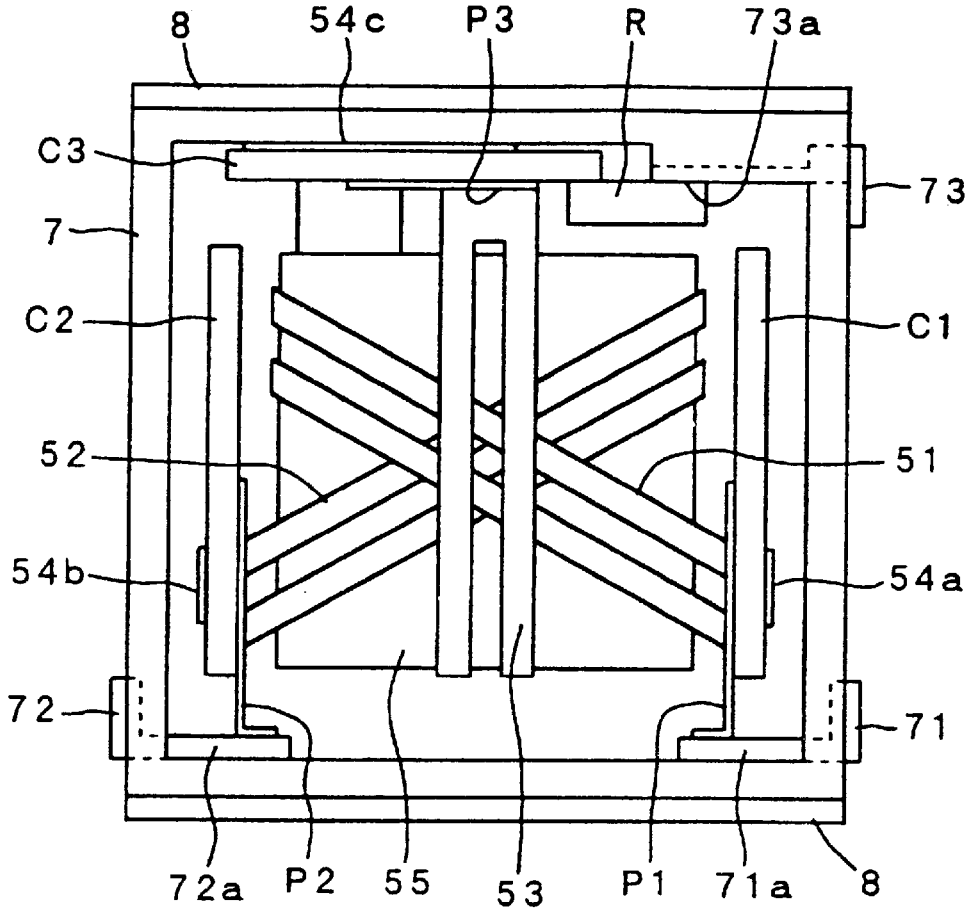
FIG. 6 shows a plan view illustrating the inner structure of the isolator in accordance with the first embodiment.

As shown in FIG. 6, the central-conductor assembly 5 and the terminating resistor R are contained in the terminal case 7. Each of the ports P1 and P2 of the central conductors 51 and 52 is connected to each of the input/output connecting electrode portions 71*a* and 72*a* by soldering or the like. An end of the terminating resistor R is connected to the ground-connecting electrode portion 73*a*, and the other end thereof is connected to the hot-side electrode of the matching capacitor C3.

As described above, in the isolator of the first embodiment, between the ports P1 to P3 of the central conductors 51 to 53 and the capacitor-connecting terminals 54*a* to 54*c* integrally disposed with the ground plate 54, the matching capacitors C1 to C3 are incorporated. With this arrangement, the matching capacitors C1 to C3, the central conductors 51 to 53, and the ferrite plate 55 can be handled as a single unit. As a result, since a complicated and time-consuming work of assembling the small matching capacitors C1 to C3 vertically stood up can be omitted, manufacturing of the isolator can be facilitated.

In addition, after connecting the matching capacitors C1 to C3 between the ports P1 to P3 of the central conductors 51 to 53 and the capacitor-connecting terminals 54*a* to 54*c*, the matching capacitors C1 to C3 are vertically stood up by bending the ports P1 to P3 of the central conductors 51 to 53 and the capacitor-connecting terminals 54*a* to 54*c*. Thus, as compared with the conventional isolator (see FIG. 10) in which the ports need to be bent before connecting the matching capacitors, steady soldering between the ports P1 to P3 and the matching capacitors C1 to C3 can be performed. Furthermore, since the ports P1 to P2 and the capacitor-connecting terminals 54*a* to 54*c* are integrally formed by using the same metal conductive plate, improved precision of the positional relationship between the ports P1 to P3 and the capacitor-connecting terminals 54*a* to 54*c* can be obtained. As a result, steadier connection among the ports P1 to P3, the matching capacitors C1 to C3, and the capacitor-connecting terminals 54*a* to 54*c* can be obtained. Moreover, without using other members, since the matching capacitors C1 to C3 are incorporated into the assembly, no increase in component cost occurs.

Figure 10:
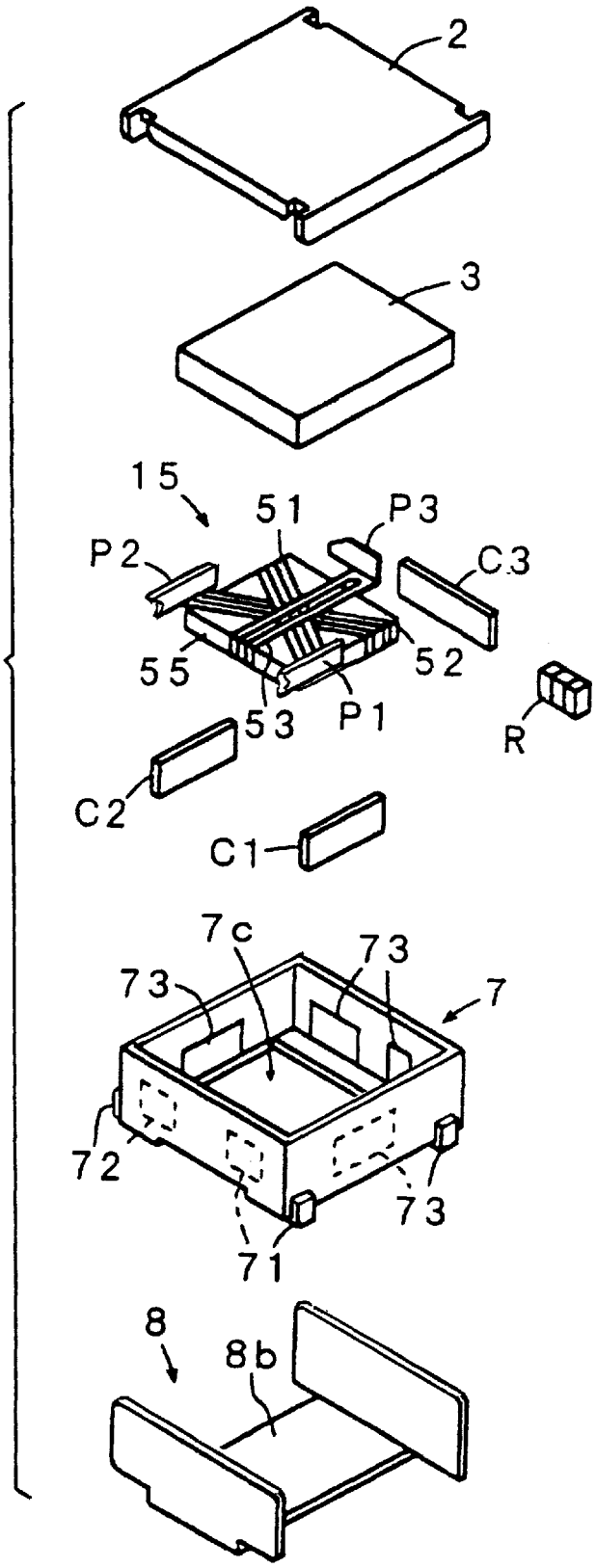
FIG. 10 shows the exploded perspective view of a conventional nonreciprocal circuit device.

In addition, since the cold-side electrode of each of the matching capacitors C1 to C3 is grounded via the ground plate 54, the grounding electrodes formed on the inner side wall of the terminal case used in the conventional art, that is, the capacitor-connecting electrodes shown in FIG. 10, can be omitted. As a result, cost of the terminal case 7 can be reduced.

Next, a description will be given of a central-conductor assembly 5 according to a second embodiment of the present invention with reference to FIGS. 7 and 8.

Figure 7:
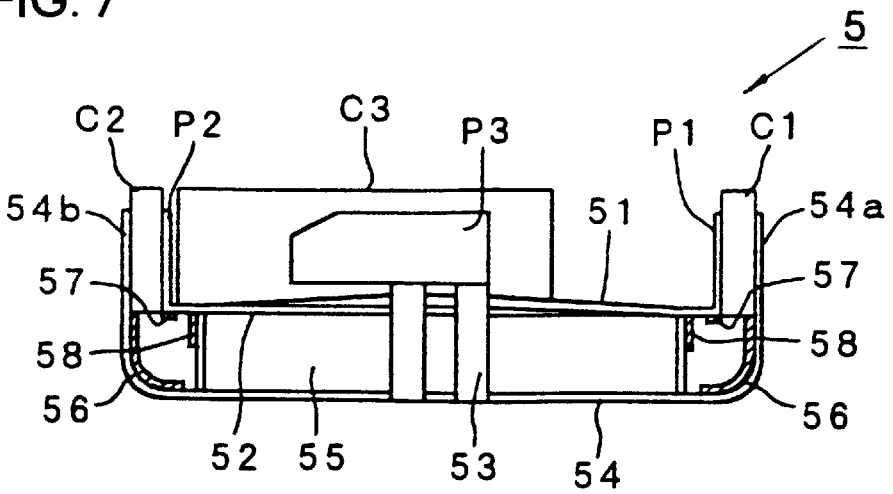
FIG. 7 shows the front view of a central-conductor assembly in accordance with a second embodiment of the present invention.
Figure 8:
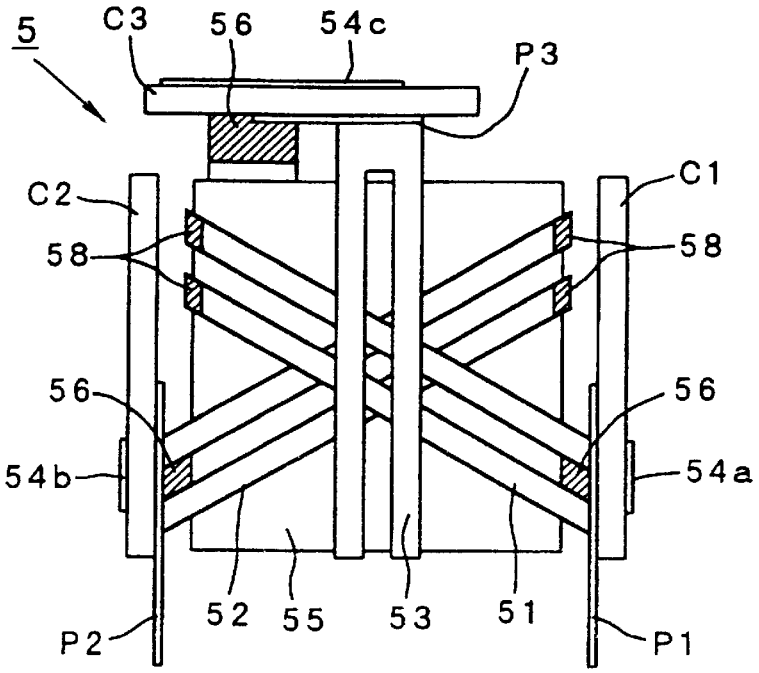
FIG. 8 shows a plan view of the central-conductor assembly in accordance with the second embodiment.

In terms of the central-conductor assembly 5 of the second embodiment, in addition to the central-conductor assembly 5 described in the first embodiment, insulators 56 and 57, which are indicated by oblique lines in FIGS. 7 and 8, are disposed to prevent outflows of solder. The insulator 56 is disposed in the vicinity of each of the parts where the capacitor-connecting terminals 54*a* to 54*c* are connected to the matching capacitors C1 to C3, and the insulator 57 is disposed in the vicinity of each of the ports P1 to P3 of the central conductors 51 to 53. The insulators 56 and 57 restrict the outflow of solder to prevent the hot-side electrodes of the matching capacitors C1 to C3 and the ground plate 54 from being short-circuited, and they prevent the hot-side electrodes and cold-side electrodes thereof from being short-circuited. Moreover, since the insulators 56 and 57 restrict the outflow of solder, the positional precision of the matching capacitors C1 to C3 can also be improved.

In addition, in the second embodiment, in order to prevent the hot-side electrodes of the matching capacitors C1 and C2 and the central conductors 51 and 52 from being short-circuited, other insulators 58 are disposed at each of parts where the central conductors 51 and 52 are arranged opposite to the hot-side electrodes of the matching capacitors C1 and C2.

Figure 2:
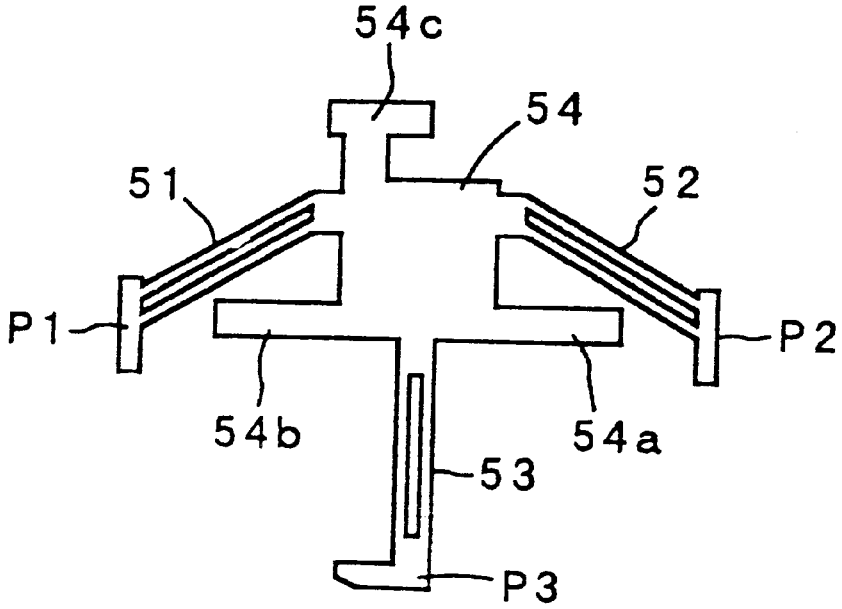
FIG. 2 shows a developed view illustrating central conductors in accordance with the first embodiment.

As the insulators 56, 57, and 58, a solder resist layer, an epoxy resin adhesive, or the like, may be used. For example, the insulators 56, 57, and 58 are disposed at specified places of the central conductors 51 to 53 and the ground plate 54 by screen printing, dispenser application, or the like, before bending processing as shown in the developed view of FIG. 2 is performed.

Additionally, the present invention is not limited to the above embodiments, and various modifications and changes can be applied within the scope of the invention. For example, although the matching capacitors C1 to C3 are all vertically disposed, that is, the electrode surfaces of the capacitors are set perpendicularly to the main surface of the ferrite member in the first and second embodiments, other arrangements are applicable to the invention.

Figure 15A:
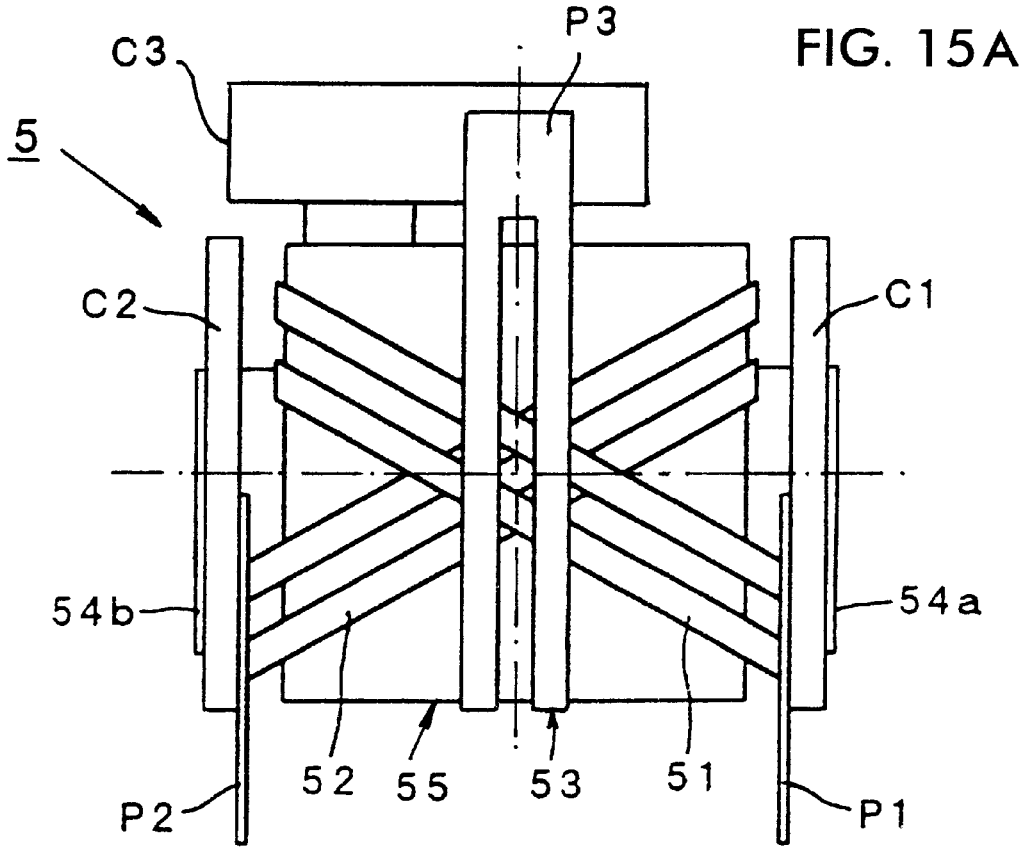
FIG. 15A shows a plan view of a central-conductor assembly in accordance with the another embodiment.
Figure 15B:
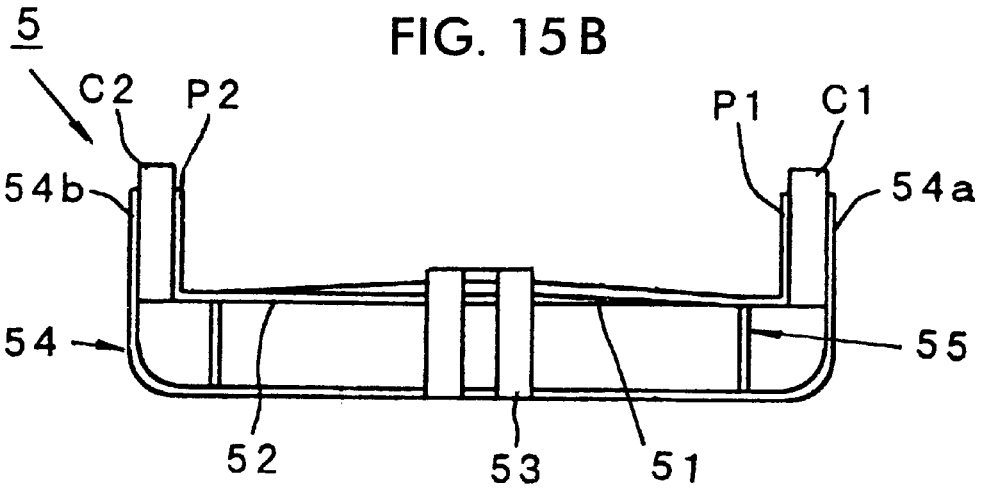
FIG. 15B is a front view of the central-conductor assembly shown in FIG. 15A.

In FIG. 15A showing a plan view of the central-conductor assembly, one of the matching capacitor is arranged in horizontal to the main surfaces of the ferrite, and FIG. 15B shows a front view of the central-conductor assembly of FIG. 15A.

All of the matching capacitors C1 to C3 need not to be vertically stood up. In FIGS. 15A and 15B, two of the matching capacitors C1 and C2 may be vertically arranged, while the remaining matching capacitor C3 may be horizontally disposed, that is, the electrode surface thereof may be arranged in parallel to the ferrite main surface. In other words, as long as at least one of the matching capacitors is disposed such that the electrode surfaces of the capacitor define an angle of 60 to 120 degrees with respect to the upper main surface of the ferrite plate, any arrangement can be used in the present invention.

Although the matching capacitors are connected by soldering in the above embodiments, the matching capacitors may be connected by using a conductive adhesive, or alternatively, laminated-type capacitors may be used as the matching capacitors. Also, regarding the above overall structure, for example, the configuration of the ferrite member may be a disk. In addition, although the above embodiments have used the isolators as the examples, a circulator formed by using the port P3 as a third input/output terminal without connecting the terminating resistor R to the port P3 may be applied to the present invention.

Figure 9:
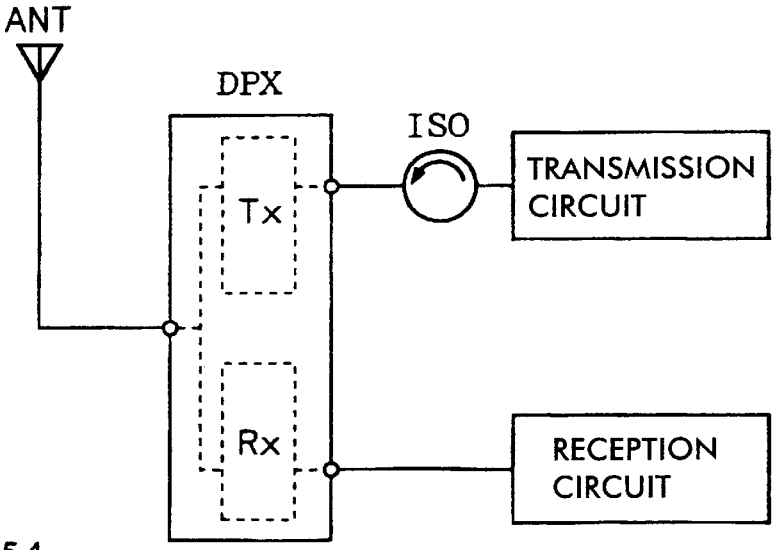
FIG. 9 shows the block diagram of a communication apparatus according to a third embodiment of the present invention.
Figure 11:
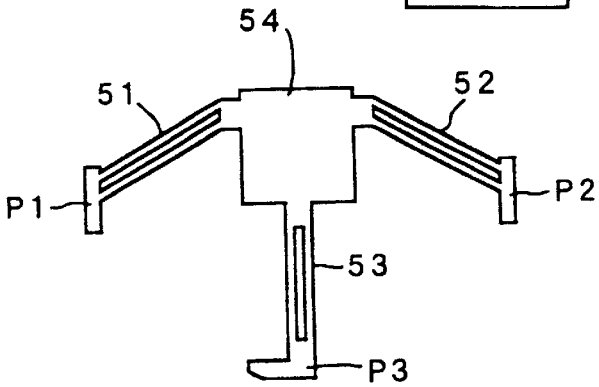
FIG. 11 shows a developed view illustrating conventional central conductors.

Next, FIG. 9 shows the structure of a communication apparatus according to a third embodiment of the present invention. In this communication apparatus, and antenna ANT is connected to an antenna end of a duplexer DPX comprising a transmission filter Tx and a reception filter Rx, an isolator ISO is connected between an input end of the transmission filter Tx and the a transmission circuit, and a reception circuit is connected to an output end of the reception filter Rx. Signals transmitted from the transmission circuit pass through the isolator ISO to the transmission filter Tx of the duplexer DPX, and is output from the antenna ANT. Signals received in the antenna ANT pass through the reception filter Rx of the duplexer DPX to be input in the reception circuit.

As the isolator ISO, one of the isolators used in the first and second embodiments can be used. With the use of the isolator in accordance with the present invention, a low-priced and highly reliable communication apparatus can be obtained.

As described above, in the nonreciprocal circuit device in accordance with the present invention, since the matching capacitors are connected between the central conductors fitted with the ferrite member and the capacitor-connecting terminals integrally formed with the central conductors, the matching capacitors integrally formed with the central conductors and the ferrite member can be regarded as a part of a single unit. As a result, since the matching capacitors can be easily incorporated into the assembly and connection reliability can be greatly enhanced, production cost is significantly reduced.

Moreover, since the insulators for preventing the outflow of solder are disposed near the parts where the capacitor-connecting terminals are connected to the matching capacitors and near the ports of the central conductors, no short circuits between the parts caused by the outflow of solder occur, thereby leading to enhancement of reliability in assembly. In addition, by disposing the insulators near the matching capacitors of the central conductors, unnecessary short circuits caused by an external force and variations in assembly can be prevented, with result that reliability can be further enhanced.

Furthermore, by using the nonreciprocal circuit device in accordance with the present invention, a low-priced highly reliable communication device can be obtained.

What is claimed is:

1. A nonreciprocal circuit device comprising:

a ferrite plate having a first main surface and a second main surface, the ferrite plate being adapted to receive a DC magnetic field applied by a permanent magnet;

a ground plate made of a conductive plate;

a plurality of central conductors integrally extended from the ground plate, an end portion of each of the central conductors defining a port;

a plurality of capacitor-connecting terminals integrally extended from the ground plate; and a plurality of matching capacitors, each having an electrode formed on each main surface thereof;

wherein the ground plate abuts on the second main surface of the ferrite plate, and the plurality of central conductors are electrically insulated from each other while being extended along the side surfaces of the ferrite plate and mutually crossing on the first main surface of the ferrite plate;

the plurality of matching capacitors are disposed between the ports of the central conductors and the plurality of capacitor-connecting terminals to be electrically connected to the ports and the terminals; and at least one of the matching capacitors are disposed in such a manner that the electrode surfaces thereof define an angle from 60 to 120 degrees with respect to one of the main surfaces of the ferrite plate.

2. A nonreciprocal circuit device according to claim 1, further comprising an insulator for preventing an outflow of solder disposed in the vicinity of each of the parts where the plurality of capacitor-connecting terminals are connected to the plurality of matching capacitors and in the vicinity of each of the ports of the plurality of central conductors.

3. A communication apparatus comprising the nonreciprocal circuit device according to claim 2.

4. A nonreciprocal circuit device according to claim 2, further comprising an insulator for preventing a short circuit disposed at each of the parts where the central conductors are close to the matching capacitors.

5. A communication apparatus comprising the nonreciprocal circuit device according to claim 4.

6. A nonreciprocal circuit device according to claim 1, further comprising an insulator for preventing a short circuit disposed at each of the parts where the central conductors are close to the matching capacitors.

7. A communication apparatus comprising the nonreciprocal circuit device according to claim 6.

8. A communication apparatus comprising the nonreciprocal circuit device according to claim 1.

* * * * *